US007861658B2

(12) United States Patent
Lee

(10) Patent No.: US 7,861,658 B2
(45) Date of Patent: Jan. 4, 2011

(54) HUMAN POWERED RAIL BIKE

(76) Inventor: Soo Haeng Lee, 2-703 Daelim Apartment, 700, Yeonhi-Dong, Seodaemun, Seoul 120-110 (KR)

( * ) Notice: Subject to any disclaimer, the term of this patent is extended or adjusted under 35 U.S.C. 154(b) by 308 days.

(21) Appl. No.: 12/090,608

(22) PCT Filed: Oct. 17, 2006

(86) PCT No.: PCT/KR2006/004201

§ 371 (c)(1),
(2), (4) Date: Aug. 27, 2008

(87) PCT Pub. No.: WO2007/046612

PCT Pub. Date: Apr. 26, 2007

(65) Prior Publication Data

US 2009/0038502 A1 Feb. 12, 2009

(30) Foreign Application Priority Data

Oct. 18, 2005 (KR) ..... 10-2005-0097958
Oct. 18, 2005 (KR) ..... 10-2005-0097959
Oct. 18, 2005 (KR) ..... 10-2005-0097961

(51) Int. Cl.
*B61D 15/10* (2006.01)
*B62K 5/00* (2006.01)
*B62K 17/00* (2006.01)

(52) U.S. Cl. ..... 105/91; 105/86; 280/222; 280/237; 280/282

(58) Field of Classification Search ..... 105/86, 105/91, 92, 95, 238.1; 280/222, 236, 237, 280/282

See application file for complete search history.

(56) References Cited

U.S. PATENT DOCUMENTS

| | | | | | |
|---|---|---|---|---|---|
| 271,720 | A | | 2/1883 | Linsley | |
| 1,013,041 | A | | 12/1911 | Mossman | |
| 1,195,380 | A | * | 8/1916 | Miller | 105/26.1 |
| 1,254,434 | A | | 1/1918 | Rea | |
| 3,920,263 | A | * | 11/1975 | Bundschuh | 280/236 |
| 3,945,449 | A | | 3/1976 | Ostrow | |
| 4,358,126 | A | * | 11/1982 | Mitchell et al. | 280/250.1 |
| 4,548,136 | A | * | 10/1985 | Yamada | 105/91 |

(Continued)

FOREIGN PATENT DOCUMENTS

JP 01218926 A 9/1989

(Continued)

*Primary Examiner*—S. Joseph Morano
*Assistant Examiner*—Zachary Kuhfuss
(74) *Attorney, Agent, or Firm*—Brooks Kushman P.C.

(57) ABSTRACT

Disclosed herein is a human powered rail bike. The rail bike includes a chassis having a predetermined shape. Rail wheels comprising a pair of front wheels and rear wheels, roll along two rails of the track which are arranged side by side. A plurality of seats is mounted to the chassis. A one-way clutch capable of changing direction limits the rotating direction of an axle to one direction, that is, a forward direction or a backward direction. A plurality of crank pedals is rotatably mounted to the chassis, and is connected to the one-way clutch capable of changing direction via a chain. A direction conversion lever functions to convert the rotating direction of the one-way clutch. Further, a pair of brake units is provided to reduce the speed of the rail bike or stop the rail bike.

11 Claims, 12 Drawing Sheets

U.S. PATENT DOCUMENTS

| | | | | | |
|---|---|---|---|---|---|
| 4,792,149 | A | * | 12/1988 | Harmon | 280/231 |
| 4,875,699 | A | * | 10/1989 | Levavi | 280/236 |
| 5,529,158 | A | | 6/1996 | Itoh et al. | |
| 5,826,897 | A | | 10/1998 | Beard | |
| 6,012,732 | A | * | 1/2000 | Potter | 280/232 |
| 6,485,042 | B1 | * | 11/2002 | Herman et al. | 280/236 |
| D520,913 | S | * | 5/2006 | Staller | D12/107 |
| D590,747 | S | * | 4/2009 | Staller | D12/107 |

FOREIGN PATENT DOCUMENTS

| | | | | |
|---|---|---|---|---|
| JP | 06344971 | A | | 12/1994 |
| KR | 91-000125 | B1 | | 1/1991 |
| KR | 20-0382360 | Y1 | | 4/2005 |
| KR | 100644348 | B1 | | 11/2006 |
| KR | 100654924 | B1 | | 11/2006 |
| KR | 100654925 | B1 | | 11/2006 |
| WO | WO 2007/096429 | | * | 7/2007 |

* cited by examiner

【Figure 1】
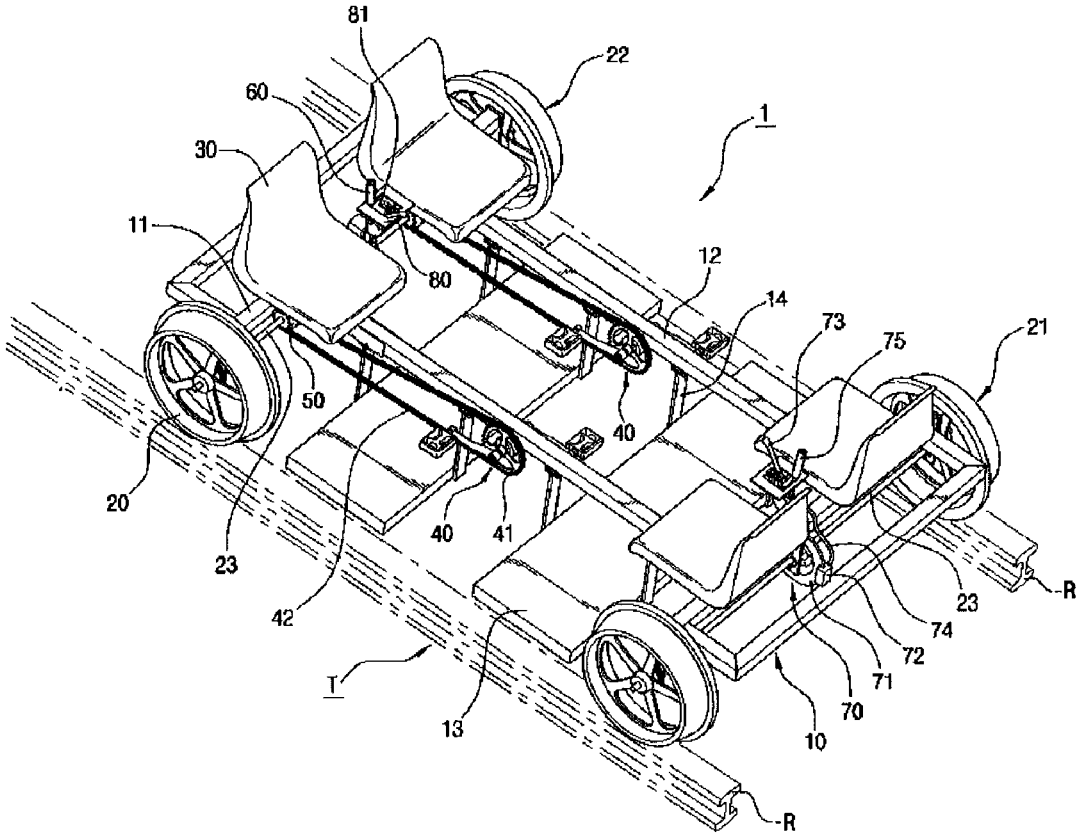

【Figure 2】
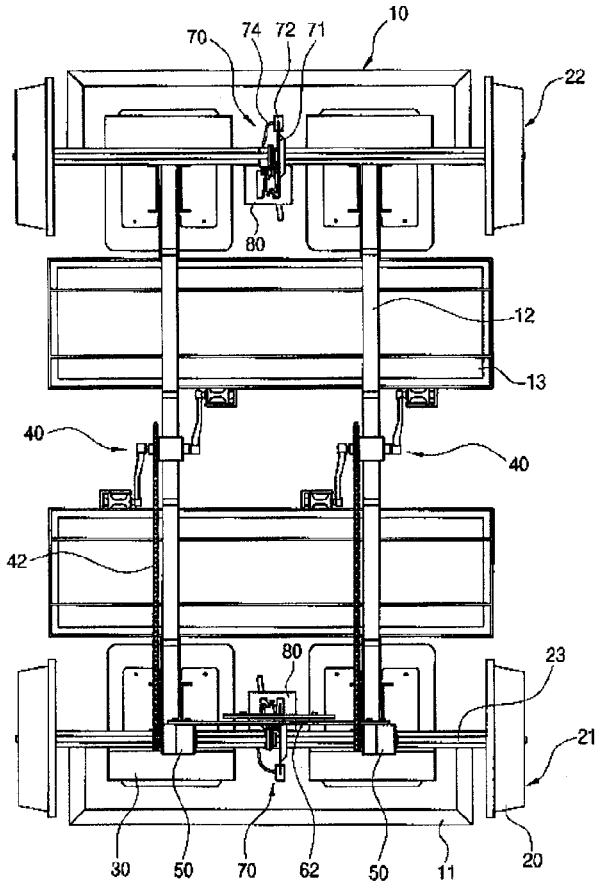
【Figure 3】
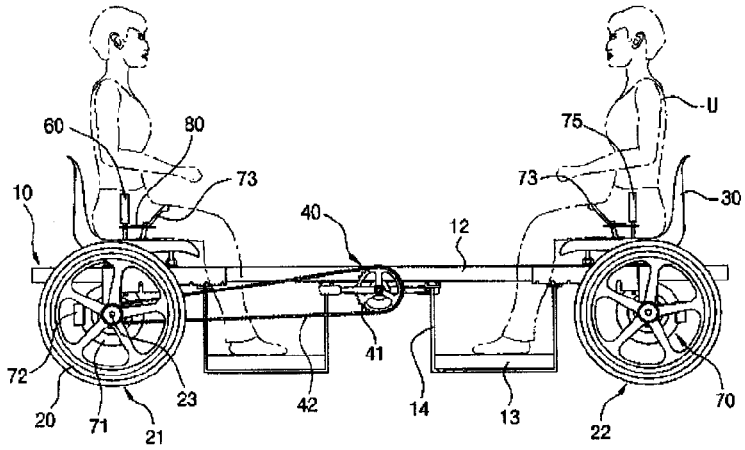

【Figure 4】
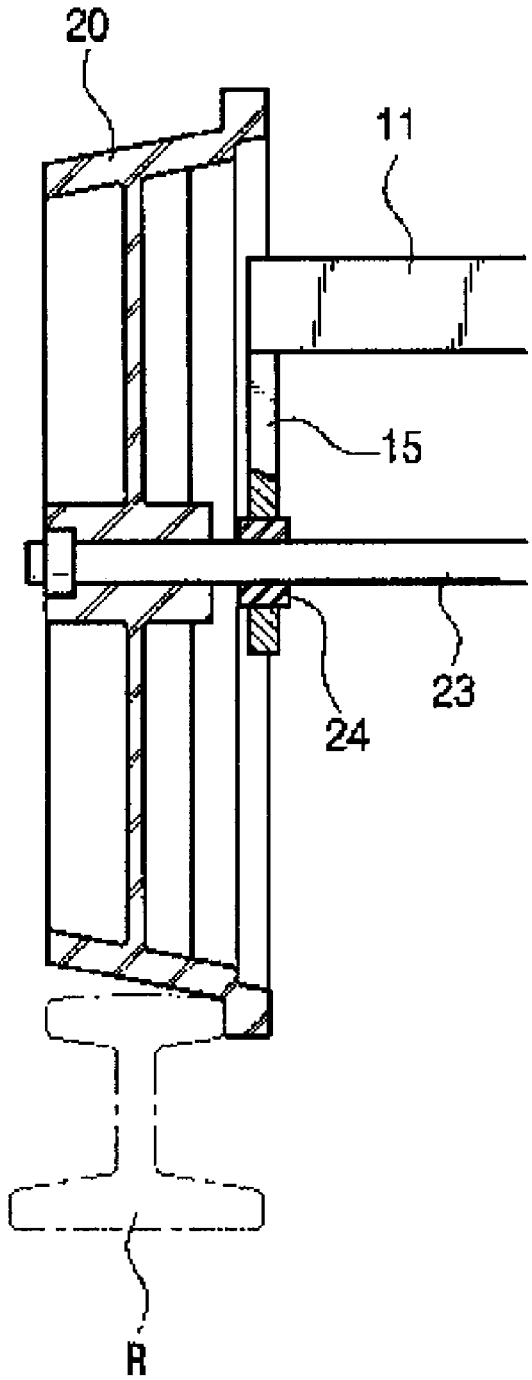

【Figure 5】
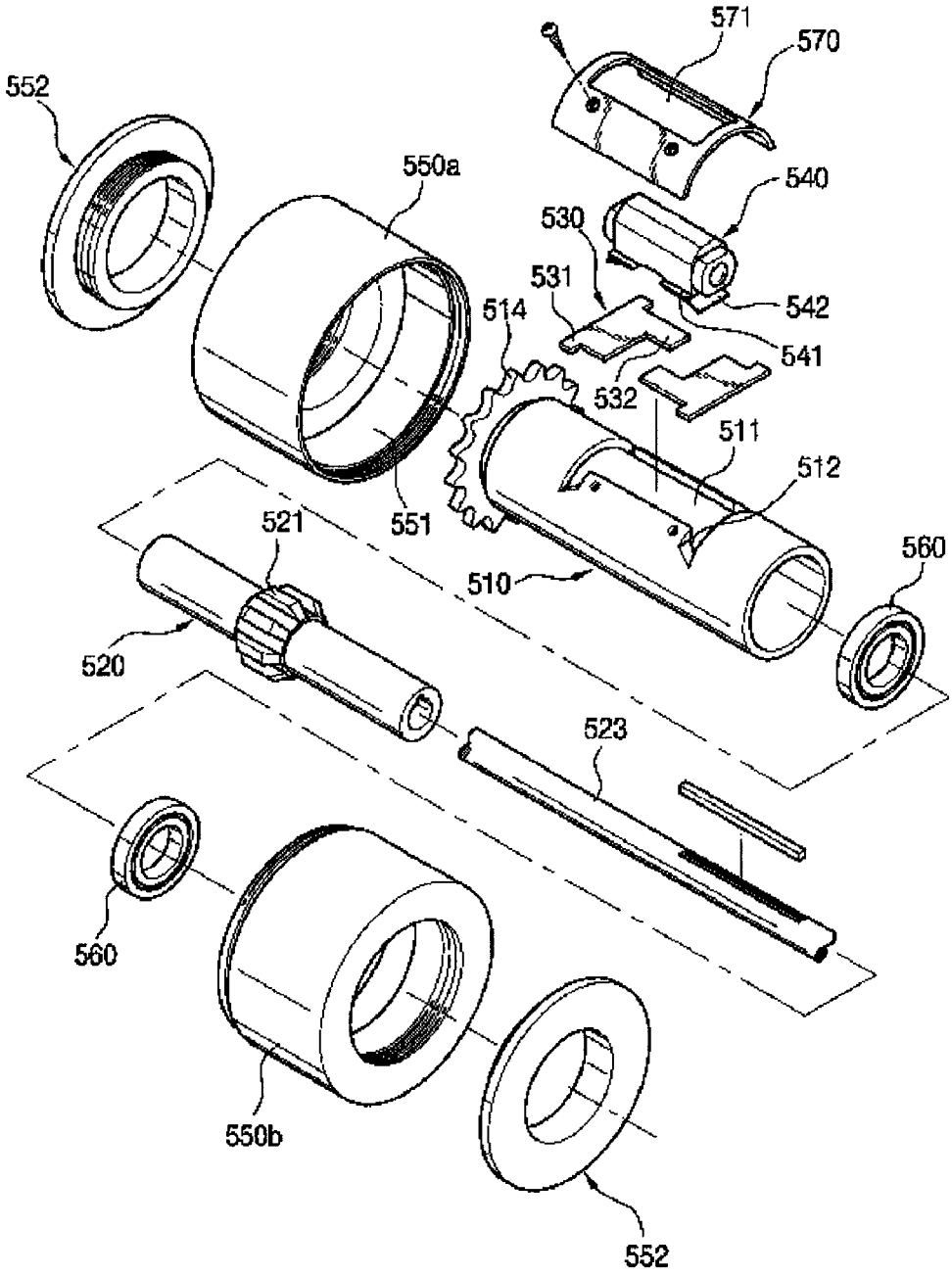

【Figure 6】
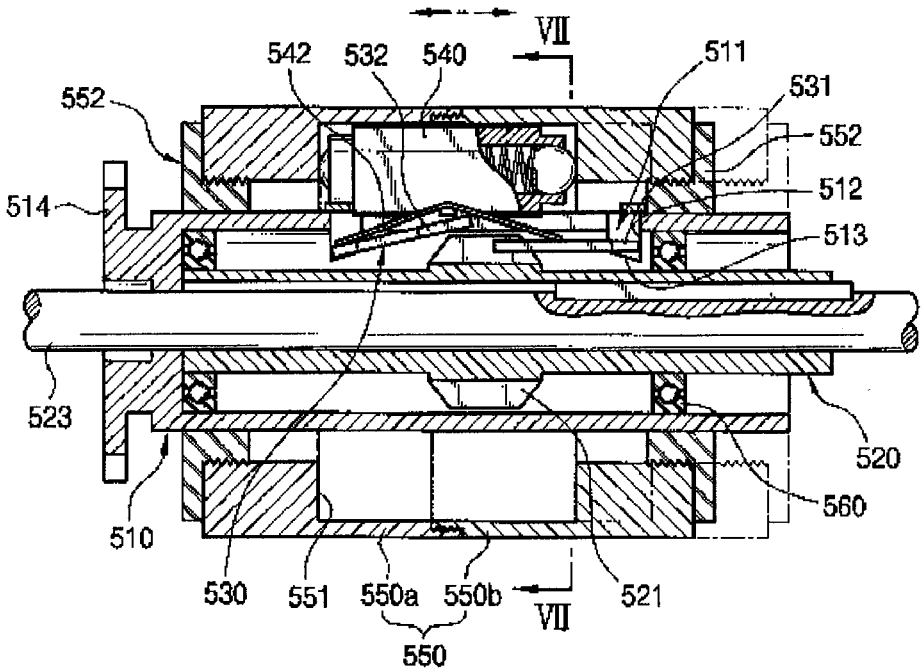
【Figure 7】
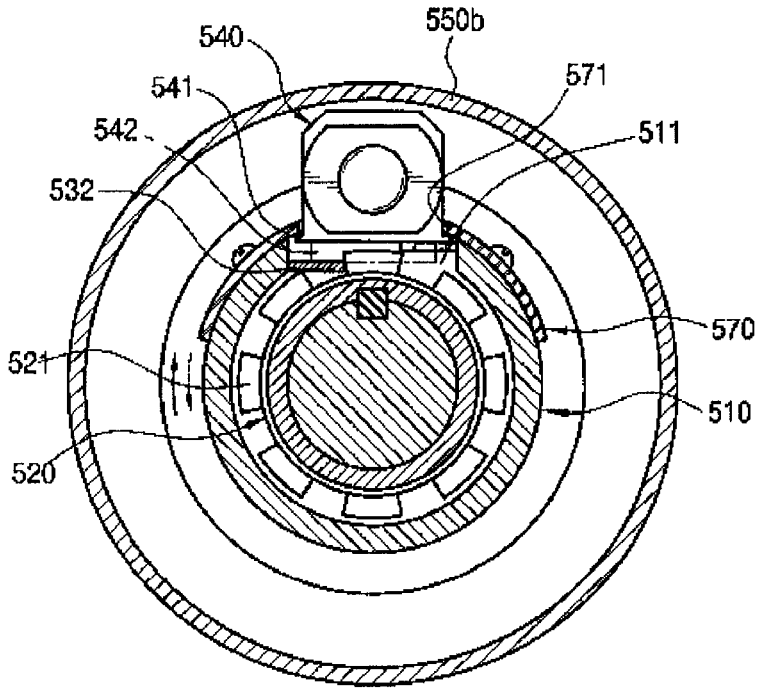

【Figure 8】
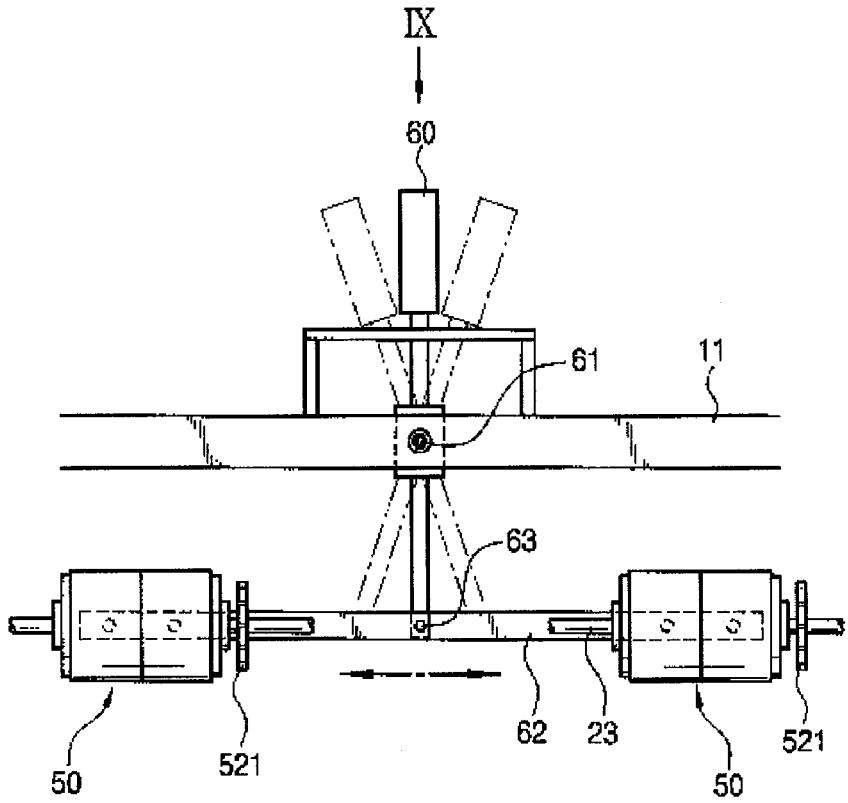
【Figure 9】
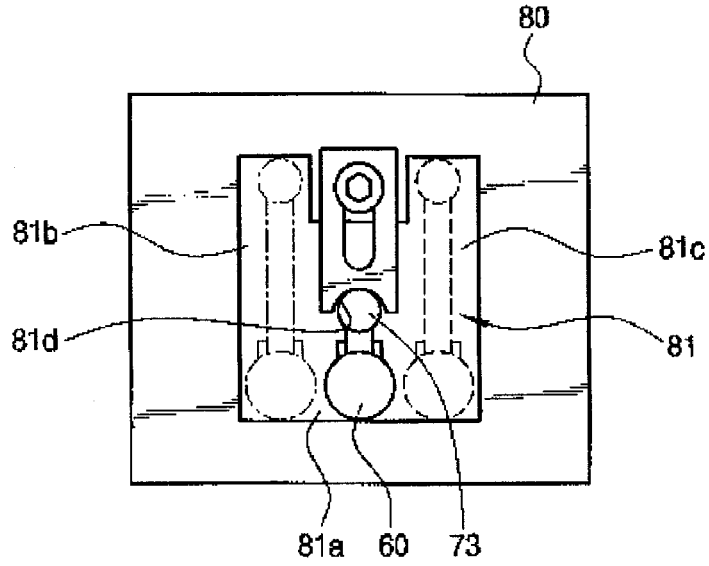

【Figure 10】
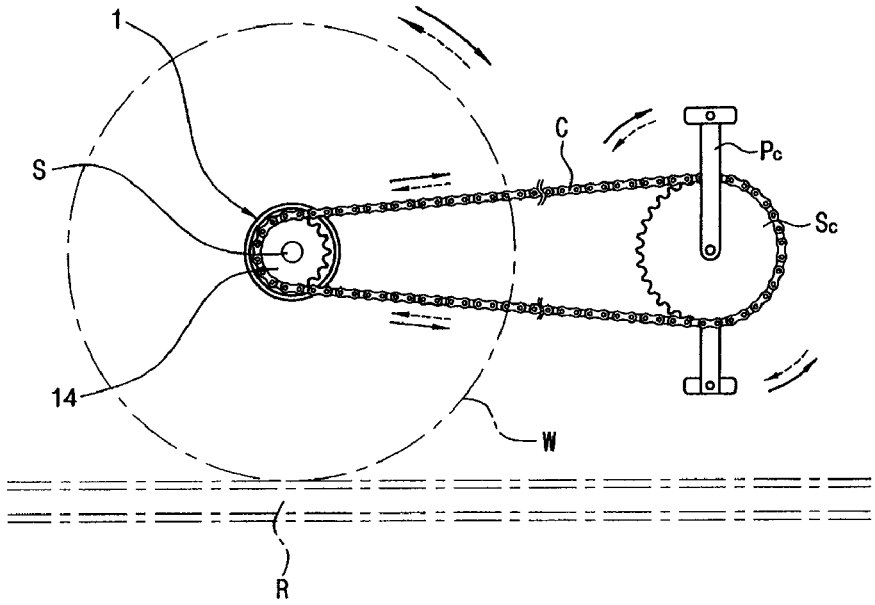
【Figure 11】
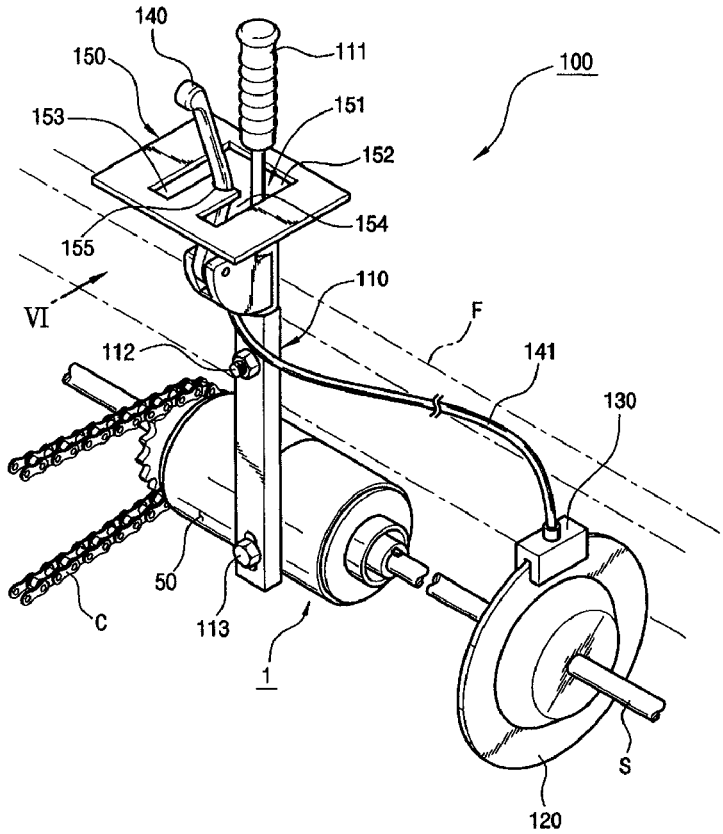

【Figure 12】
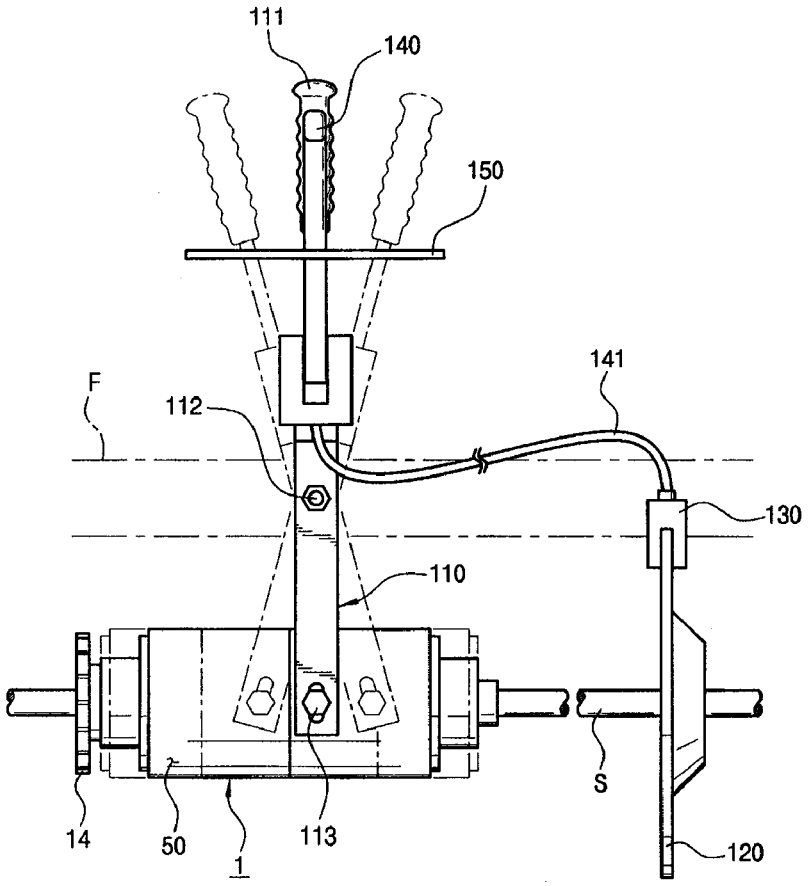
【Figure 13a】
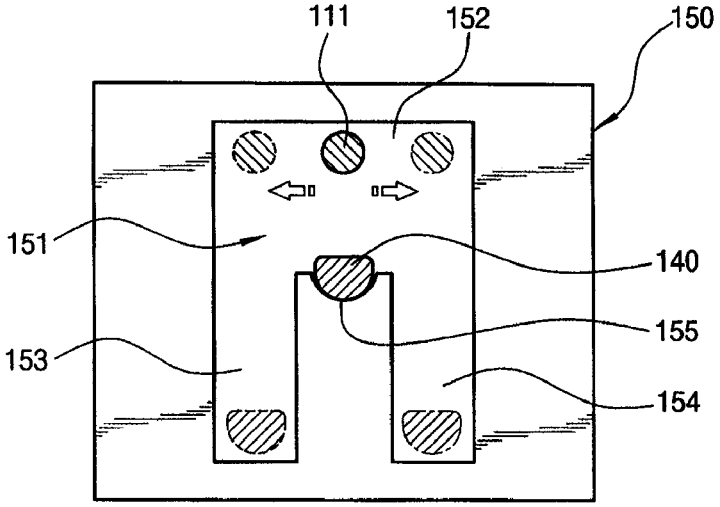

【Figure 13b】
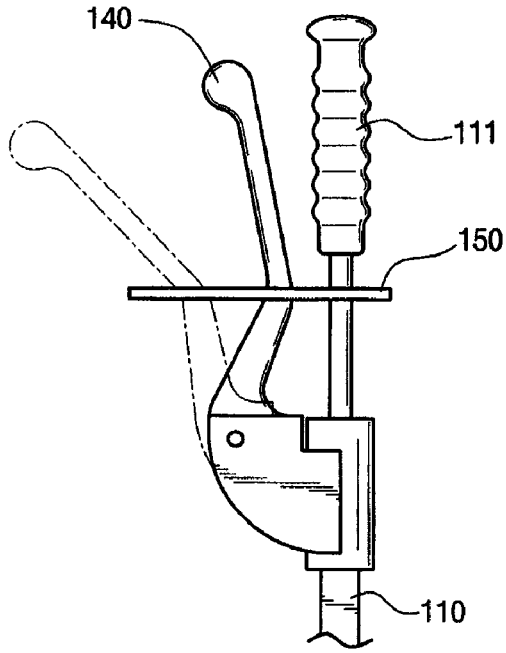
【Figure 14】
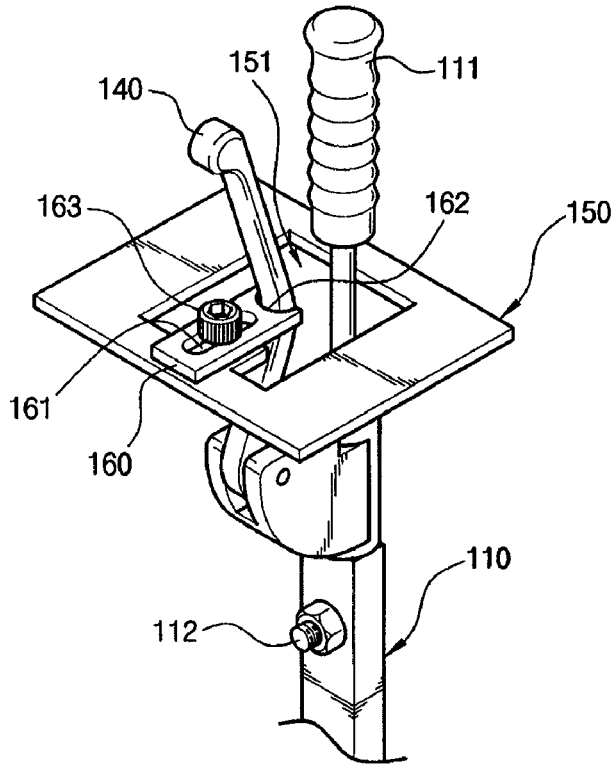

【Figure 15】
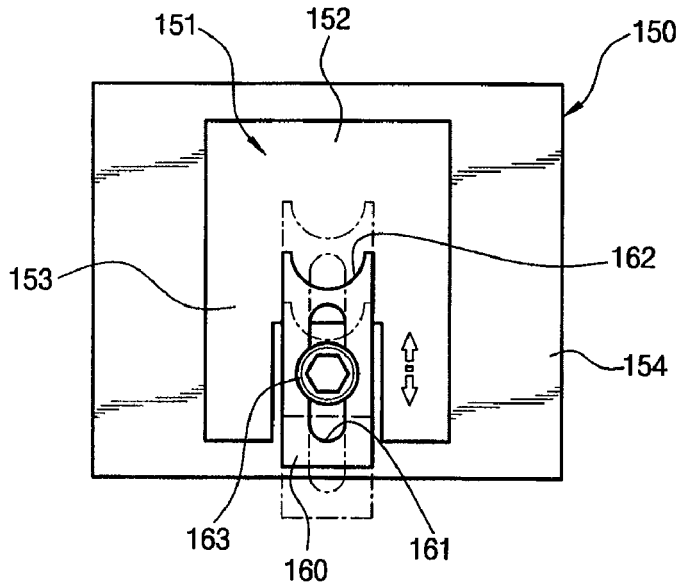
【Figure 16】
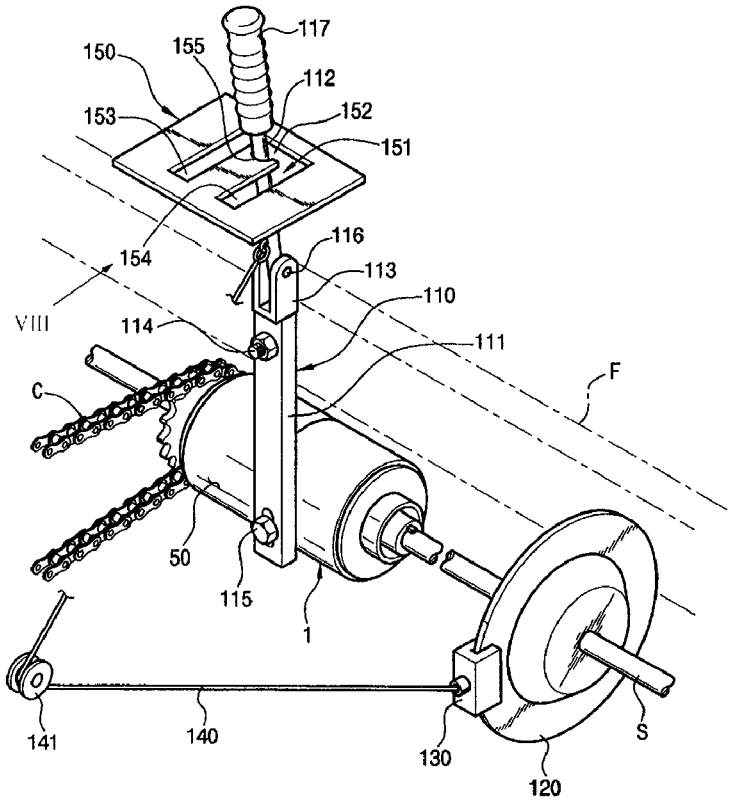

【Figure 17】
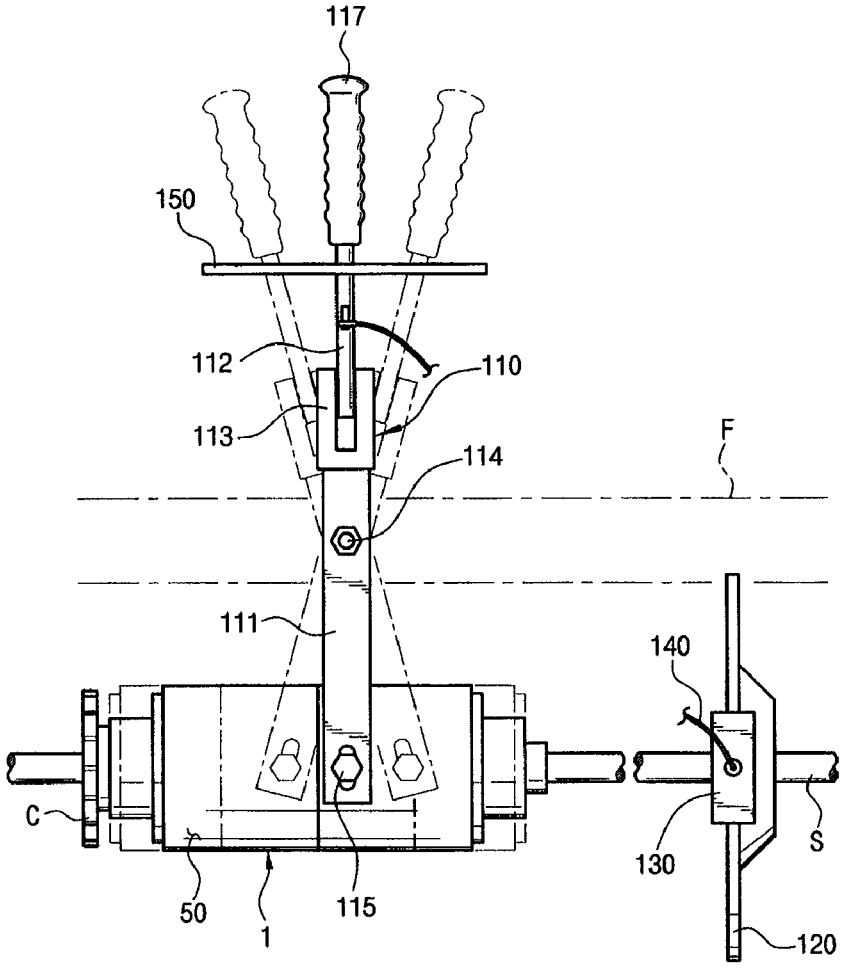
【Figure 18a】
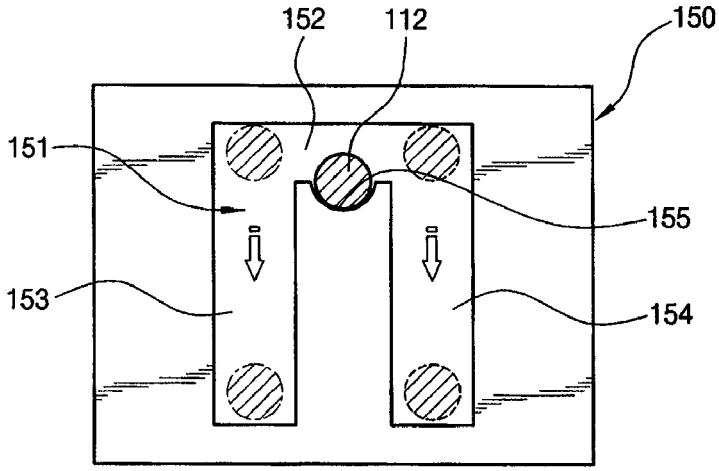

【Figure 18b】
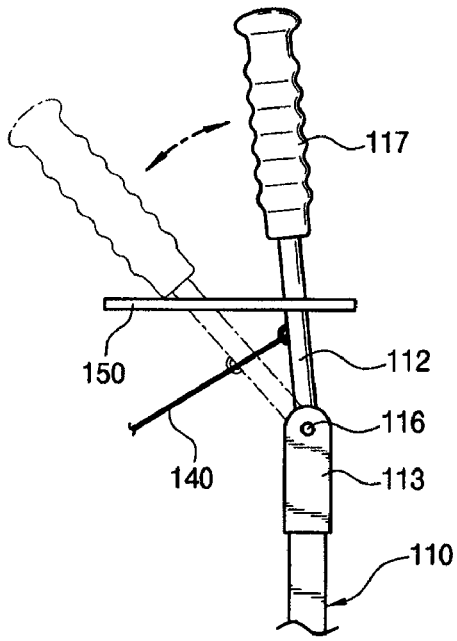
【Figure 19】
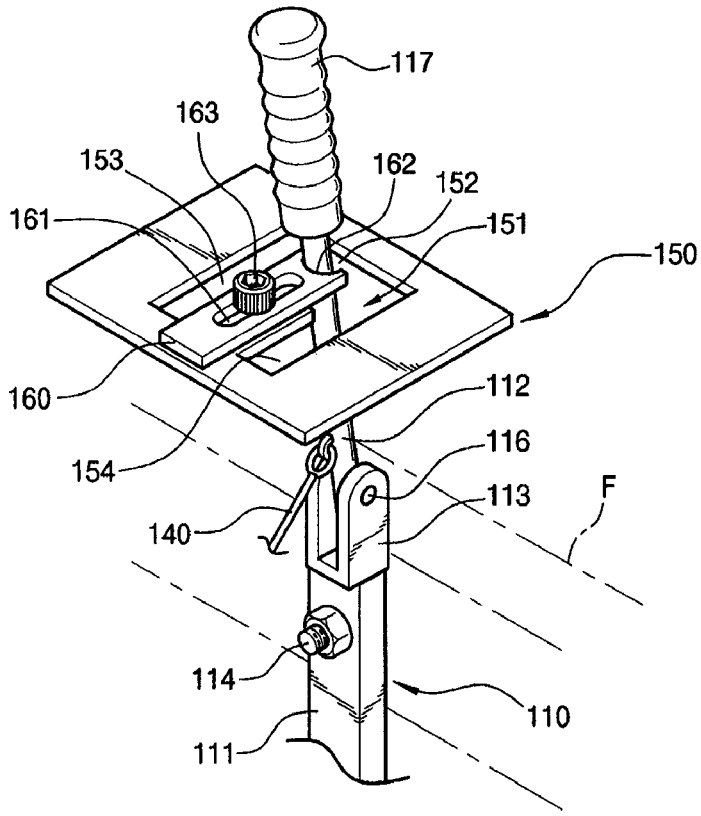

HUMAN POWERED RAIL BIKE

TECHNICAL FIELD

The present invention relates, in general, to a human powered rail bike moved along rails by human power and, more particularly, to a human powered rail bike, which has a one-way clutch capable of changing direction, so that several passengers sit opposite each other, thus conveniently moving forwards or backwards, and allowing forward or backward movement to be selectively conducted without the necessity of exchanging the passengers seats with each other, and allowing the passengers to alternately pedal during the movement, and safely converting a power transmission direction of the one-way clutch only when driving wheels are completely stopped and restrained.

BACKGROUND ART

Recently, as the possibility of the exhaustion of limited petroleum resources and environmental problems, such as air pollution caused by exhaust gas from vehicles, constitute serious social problems, the exploitation of environment-friendly alternative energy sources and research on new transportation means have actively progressed. Thus, several means, such as an electric vehicle or a hydrogen fueled car, have been proposed. In particular, interest in a "human powered vehicle", which is used as a transportation means for a relatively short distance and obtains its propelling force from human power, has increased.

Currently, a representative transportation means driven by human power is a general bicycle, which is driven by a crank wheel system for two wheels. Such a bicycle permits free movement, but has very low driving stability because of structural characteristics. Further, only one person may ride the bicycle, so that it is difficult to actually use the bicycle as a systematic transportation means.

Another type of human powered vehicle has been proposed in U.S. Pat. No. 271,720, No. 1,013,041, etc, which disclose a railroad velocipede. The railroad velocipede is constructed so that wheels are rotated by the swinging movement of an actuating lever connected to the wheels via a link mechanism, and are driven along rails.

However, the railroad velocipede has a construction similar to that of a general bicycle. That is, a pair of main wheels, which are provided at front and rear positions, is mounted on one rail of the track, and one subsidiary wheel is mounted on the other rail of the track, thus supporting and guiding the body of the velocipede. Hence, the number of passengers is limited to one or two, and the stability is poor. Further, the actuating lever is operated with both hands, so that the action of the passengers is very restricted while driving, and thus the invention is not convenient.

For these reasons, the railroad velocipede is used only as a moving means in a special situation, for example, railroad repair work, but is not used as a public transportation means. Especially, since the railroad velocipede is directional, the railroad velocipede may be driven in only one direction (a forward direction). When one desires to reverse the direction (backwards direction), the body of the velocipede must be lifted and rotated to face the opposite direction, thus inconveniencing the passengers.

Meanwhile, recently, a new railroad velocipede has been proposed. The railroad velocipede is provided with four wheels, like an automobile. The wheels are stably mounted on both rails of a track. The railroad velocipede can be easily driven by the pedaling of a crank wheel system. The railroad velocipede has several seats, so that a relatively large number of passengers can ride the railroad velocipede.

However, the four-wheeled railroad velocipede moves in only one direction, so that it is impossible to reverse the direction thereof (conduct forward and backward movement). Thus, when a passenger desires to move the railroad velocipede backwards, the body of the velocipede must be raised and rotated. Further, when it is required to change a driver during the driving, the railroad velocipede must be stopped and passengers must exchange seats with each other. Thus, it is difficult to smoothly drive the railroad velocipede. For these reasons, when the railroad velocipede is driven without changing the driver, the physical strength of the driver may be excessively consumed, so that it is difficult to drive a long distance.

Further, a one-way clutch is a device which transmits power from a driving shaft to a driven shaft only in one direction in a power transmission device the driving shaft and driven shaft of which are driven in the same direction, like a chain drive or a belt drive. The one-way clutch has been widely used in various kinds of devices which do not require the conversion of the driving direction, for example, a bicycle and a motorcycle.

For example, U.S. Pat. No. 1,254,434 proposed a human powered vehicle which is driven on a railroad by a crank pedal system using a chain. The human powered vehicle may require backward movement. However, the conventional one-way clutch cannot change the power transmission direction. Thus, when it is required to move backward, the human powered vehicle must be pushed backwards or must be lifted in order to change its direction.

In order to apply a one-way clutch capable of changing direction to the human powered vehicle, a direction conversion means for changing the power transmission direction from the exterior must be also provided. In particular, if the direction conversion means is manipulated during the driving, the human powered vehicle may endanger the passengers, because of the structural characteristics of the human powered vehicle. Thus, for safety, the power transmission direction must be converted when the vehicle is completely stopped.

DISCLOSURE

Technical Problem

Accordingly, the present invention has been made keeping in mind the above problems occurring in the prior art, and an object of the present invention is to provide a human powered rail bike, which allows a relatively large number of people to ride, and is mounted simultaneously on both rails of a track, thus permitting safe driving, and which can be driven in opposite directions, thus being continuously movable without changing the direction of the rail bike or requiring seats to be exchanged when converting between forward and backward movement.

Another object of the present invention is to provide a human powered rail bike, which allows a plurality of people to face each other and move, thus allowing the people to conveniently and alternately pedal without exchanging seats with each other, therefore preventing excessive consumption of physical strength, and conveniently moving a relatively long distance.

A further object of the present invention is to provide a human powered rail bike, which is capable of precisely and safely decreasing speed and braking regardless of whether movement is forward or backward, thus automatically maintaining the braking state when changing direction between forward and backward movement.

Yet another object of the present invention is to provide a human powered rail bike, which is capable of safely converting the power transmission direction of a one-way clutch only when driving wheels are completely stopped or restrained, when the one-way clutch capable of changing direction converts the power transmission direction so that power is transmitted to a driven shaft only in one direction, that is, a forward or backward direction according to the rotating direction of a driving source in a driving device the driving shaft and driven shaft of which have the same rotating direction, like a chain drive or a belt drive.

Technical Solution

In order to accomplish the objects, the present invention provides a human powered rail bike, including a chassis having a predetermined shape; rail wheels comprising a pair of front wheels and rear wheels, which are mounted to front and rear portions of the chassis, are spaced apart from each other, and movably support the chassis on a track, the front and rear wheels being connected via respective axles and rolling along two rails of the track which are arranged side by side; a plurality of seats mounted to the chassis, and arranged parallel to the track to be spaced apart from each other and face each other; a one-way clutch capable of changing direction, the one-way clutch mounted to at least one axle and limiting a rotating direction of the associated axle to one direction, that is, a forward direction or a backward direction; a plurality of crank pedals positioned at a center between the facing seats and rotatably mounted to the chassis, each of the crank pedals being connected to the one-way clutch capable of changing direction via a chain; a direction conversion lever for converting a rotating direction of the one-way clutch capable of changing the direction; and a pair of brake units mounted to the front and rear portions of the chassis, and selectively or simultaneously reducing rotating speed of the front and rear wheels or stopping the front and rear wheels according to a moving direction.

According to an aspect of the invention, each of the brake units comprises a hydraulic brake having a brake disc secured to each of the axles, a hydraulic caliper selectively holding the brake disc, and a hand brake lever connected to the caliper via a cable and operating the caliper, and the hand brake lever is mounted to the direction conversion lever, so that a direction conversion operation is safely conducted in the completely braked state.

According to another aspect of this invention, each of the seats is mounted to the chassis to be movable in a moving direction and to be secured to a predetermined position, so that an interval between the seat and the crank pedals is adjustable according to the body dimensions of a passenger.

In order to accomplish the objects, the present invention provides a safety switch device for manipulating a one-way clutch capable of changing direction from an exterior, the one-way clutch including an outer sleeve having in a circumferential surface thereof a guide slot and connected to a shaft of a driving source via power transmission means, an inner sleeve radially having on an outer circumference thereof a plurality of locking protrusions to correspond to the guide slot, rotatably coupled to the outer sleeve, and secured to a driven shaft equipped with driving wheels, a pair of ratchet plates supported on both ends of the guide slot to undergo lever movement, a switching block moving in the guide slot in an axial direction thereof and alternately positioning each of the ratchet plates between each of the locking protrusions and a circumferential side of the guide slot, and a manipulation cover secured to surround the outer sleeve and moving the switching block.

In this case, the safety switch device includes a direction conversion lever having on an upper end thereof a handle and supported to a chassis via a pivot, a lower end of the direction conversion lever being connected to the manipulation cover of the one-way clutch; a brake disc secured to the driven shaft equipped with a driving wheel; a hydraulic caliper selectively holding the brake disc, thus restraining or releasing the brake disc; a hand brake lever connected to the hydraulic caliper via a cable, and mounted to the direction conversion lever via a pivot to move towards or away from the handle, thus operating the hydraulic caliper; and a guide plate having a shift range slot including a shift part permitting movement of the direction conversion lever only when the hand brake lever is pulled and the brake disc is restrained by the hydraulic caliper, and positioning parts bent and extended from both ends of the shift part in the same direction, releasing restraint of the hand brake lever, and preventing movement of the direction conversion lever.

Further, the safety switch device includes a direction conversion lever having a first lever pivoted at an upper end thereof to a chassis and connected at a lower end thereof to the manipulation cover of the one-way clutch, and a second lever pivoted to the upper end of the first lever to be operated in a direction perpendicular to the first lever; a brake disc secured to the driven shaft equipped with a driving wheel; a hydraulic caliper selectively holding the brake disc, thus restraining or releasing the brake disc; a brake wire connecting the second lever of the direction conversion lever to the hydraulic caliper, and elastically biased towards the hydraulic caliper; and a guide plate having a shift range slot including a shift part permitting rotation of the first lever only when the second lever of the direction conversion lever is pulled and the brake disc is restrained by the hydraulic caliper, and positioning parts bent and extended from both ends of the shift part in the same direction, releasing restraint of the second lever, and preventing rotation of the first lever.

According to the present invention, the shift range slot of the guide plate has a rectangular shape, and a gap adjusting plate, having a longitudinal hole for adjusting a position in an operating direction of the hand brake lever, is fastened to one side of the guide plate, thus partitioning the shift range slot into the shift part and the positioning parts, and adjusting the width of the shift part.

Thus, when the power transmission direction of the one-way clutch capable of changing direction which is mounted to a device the driving shaft and driven shaft of which are rotated in the same direction, like a chain drive or a belt drive, and transmits power to the driven shaft in only one direction, that is, forwards or backwards, according to the rotating direction of a driving source, is changed, the hand brake lever is pulled so that the driving wheels are completely stopped and restrained. In such a state, the manipulation of the direction conversion lever is possible, so that the power transmission direction of the one-way clutch can be very safely changed.

Therefore, the present invention considerably enhances the reliability, safety, and convenience of the device equipped with the one-way clutch capable of changing direction, especially a human powered vehicle such as a rail bike.

Advantageous Effects

As described above, the present invention provides a human powered rail bike, which allows several people to ride therein, can be very stably moved on a track, and allows the rail bike to move in opposite directions, thus converting forward or backward movement without requiring the body of the bike to be turned to face the opposite direction.

Moreover, several people sit opposite each other and move a rail bike using crank pedals which are provided between them, thus allowing them to conveniently alternately pedal without the necessity of exchanging seats with each other while driving, therefore minimizing the consumption of physical strength and easily moving long distances.

Further, brake units are provided on the front and rear portions of a chassis, so that passengers who are facing the moving direction during forward or backward movement regardless of which passengers are pedaling can reduce the speed of a rail bike or can brake the rail bike, and thus the rail bike is always safely driven or braked, regardless of whether it is moving forward or backward. Especially, a hand brake lever is integrally mounted to a direction conversion lever, thus automatically maintaining a braking state when conversion between the forward or backward direction is made.

Further, the present invention provides a safety switch device for manipulating a one-way clutch capable of changing direction, in which a hand brake lever or a second lever of a direction conversion lever is pulled when the power transmission direction of the one-way clutch capable of changing direction, which is mounted to a device the driving shaft and driven shaft of which are rotated in the same direction, like a chain drive or a belt drive, and transmits power to the driven shaft in only one direction, namely, a forward or backward direction according to the rotating direction of a driving source, is changed, so that it is possible to manipulate the direction conversion lever only when driving wheels are restrained to be completely stopped, thus very safely converting the power transmission direction of the one-way clutch.

Further, an additional brake device can be removed from a device having a one-way clutch capable of changing direction, for example, a human powered vehicle, such as a rail bike.

Therefore, the present invention greatly contributes to the stability, reliability, driving stability, and convenience of a human powered rail bike.

DESCRIPTION OF DRAWINGS

FIG. 1 is a perspective view schematically showing the construction of a human powered rail bike, according to the present invention;

FIG. 2 is a bottom view showing the construction of the human powered rail bike, according to the present invention;

FIG. 3 is a side view showing the construction of the human powered rail bike, according to the present invention;

FIG. 4 is an extracted sectional view schematically showing a coupling structure of a rail wheel with a chassis;

FIG. 5 is an exploded perspective view showing a one-way clutch of the human powered rail bike, according to the present invention;

FIG. 6 is a sectional view showing the assembled state of FIG. 5;

FIG. 7 is a sectional view taken along line VII-VII of FIG. 6;

FIG. 8 is a side view schematically showing a direction converting structure for the one-way clutch;

FIG. 9 is an extracted plan view taken along IX of FIG. 8;

FIG. 10 is a side view schematically showing the use of another one-way clutch capable of changing direction, according to the present invention;

FIG. 11 is a perspective view showing a safety switch device for manipulating another one-way clutch capable of changing direction, according to the present invention;

FIG. 12 is a front view taken along VI of FIG. 11;

FIGS. 13*a* and 13*b* are an extracted plan view and a side view schematically showing the operation of the safety switch device, according to the present invention;

FIG. 14 is a perspective view showing important parts of another safety switch device, according to the present invention;

FIG. 15 is an extracted plan view showing the operation of a gap adjusting plate of the safety switch device, according to the present invention;

FIG. 16 is a perspective view showing a further safety switch device for manipulating a one-way clutch capable of changing direction, according to the present invention;

FIG. 17 is a front view taken along VIII of FIG. 16;

FIGS. 18*a* and 18*b* are an extracted plan view and a side view schematically showing the operation of the safety switch device, according to the present invention; and FIG. 19 is a perspective view showing another safety switch device, according to the present invention.

Mode for Invention

The above and other objects, features and advantages of the present invention will be more clearly understood from the following detailed description taken in conjunction with the accompanying drawings.

As shown in FIGS. 1 to 3, a human powered rail bike according to the present invention includes a chassis 10. A plurality of rail wheels 20 supports the chassis 10 such that the chassis is movable along two parallel rails R of a track T. A plurality of seats 30 is mounted on the chassis 10. The rail bike also includes crank pedals 40 which transform the human power of passengers U into propelling power. One-way clutches 50 selectively limit the rotating direction of the rail wheels 20 to one direction so that the rail wheels rotate either forwards or backwards. A direction conversion lever 60 function to convert the rotating direction of the one-way clutches 50. Brake units 70 reduce the speed of the driving rail bike 1 or stop the rail bike.

The chassis 10 may have various constructions. For example, the chassis 10 has a pair of left and right frames 11 which are arranged side by side and are spaced apart from each other by a predetermined interval, and a pair of front and rear frames 12 which are arranged side by side and couple the left and right frames 11 to each other.

In this case, the front and rear frames 12 are provided at inner positions which are spaced from both ends of the left and right frames 11 by predetermined distances. Such an arrangement allows passengers U to easily get on or off the rail bike, and allows two passengers U who sit side by side to manipulate the respective crank pedals 40.

Further, upper plates 13 for the comfort of the passengers U are provided in areas under the front and rear frames 12 that do not hinder the movement of the pedals 40, such that the upper plates protrude to both sides of the front and rear frames 12. The upper plates are attached to and supported by the front and rear frames 12 via a plurality of hanger frames 14.

The number of rails wheels 20 is four. Two rail wheels are supported on opposite ends of each axle 23. The rail wheels comprise front wheels 21 and rear wheels 22. As shown in FIG. 4, brackets 15 protrude under the left and right frames 11 of the chassis 10. The front wheels 21 and the rear wheels 22 are mounted to the chassis 10 by rotatable coupling each axle 23 to the brackets 15, intermediated by a bearing 24.

The rail wheels 20 may be made of metal. Preferably, the rail wheels are formed using urethane so as to realize a light bike.

For example, four seats 30 are provided and mounted on both ends of the front and rear frames 12 of the chassis 10 so that they face each other. Such a construction allows the passenger U sitting in each of the seats 30 to manipulate the crank pedal 40 provided between the two seats 30 in a driving direction, and always ensures forward vision in the driving direction in the rail bike 1 of the present invention, which is movable in both directions, that is, forwards and backwards.

Preferably, each seat 30 is movably installed to the front and rear frames 12 of the chassis 10, thus allowing each crank pedal 40 to be manipulated regardless of body dimensions by appropriately adjusting the seat 30 relative to the crank pedal 40 according to the body dimensions of each passenger U, that is, the height of each passenger.

The crank pedals 40 are rotatably installed at the center of each of the front and rear frames 12 and are positioned between two opposing pairs of seats 30, thus allowing the passengers U sitting in the opposite two seats 30 to manipulate the crank pedals 40. A chain sprocket 41 is provided to be concentric with each crank pedal 40, and is coupled to a chain sprocket 514 of the corresponding one-way clutch 50 via a chain 42.

For example, two one-way clutches 50 are provided, and are mounted simultaneously to the axle 23 of either of the front wheels 21 or the rear wheels 22 of the rail wheels 20. Of course, the one-way clutch 50 may be mounted to each of the axles 23 of the front wheels 21 and the rear wheels 22. However, in this case, two one-way clutches 50, which are installed to the front and rear wheels 21 and 22, respectively, must be manipulated to have the same rotating direction, thus causing incorrect manipulation. Therefore, it is preferable that two one-way clutches 50 both be mounted to one of the axles 23 such that they are spaced apart from each other by a predetermined interval.

Only when a load is applied to the one-way clutches 50, that is, the passengers U manipulate the crank pedals 40 to rotate the chain sprockets 41, are the one-way clutches 50 selectively coupled to the axle 23 of the driving wheels, thus rotating the axle 23 in a propelling direction. Otherwise, the one-way clutches 50 maintain a free state (relative idle rotating state) with respect to the axle 23.

The reason why the one-way clutches are operated as such is follows. That is, even if the crank pedals 40 stop operating when the passengers U desire to take a rest for a while during the driving operation, the driving axle 23 must continue to rotate due to inertia regardless of whether the chain sprockets 41 are rotating or not.

Meanwhile, the one-way clutches 50 of the present invention use a "one-way clutch capable of changing direction", which was invented by the inventor of the present invention and is disclosed in Korean Patent Appln. No. 10-2005-0018271.

As shown in FIGS. 5 to 7, each one-way clutch 50 includes an outer sleeve 510, an inner sleeve 520, a pair of ratchet plates 530, a switching block 540, and a manipulation cover 550. The outer sleeve 510 has on one end thereof the chain sprocket 514, and is coupled to the chain sprocket 41 of the crank pedal 40 via the chain 42. The axle 23 of the front wheels 21 or the rear wheels 22 is fitted into the inner sleeve 520, with a plurality of locking protrusions 521 provided on part of the outer circumference of the inner sleeve at regular angular intervals. The ratchet plates 530 are mounted to the outer sleeve 510, and are selectively locked to both sides of the locking protrusion 521 of the inner sleeve 520, thus moving the outer and inner sleeves 510 and 520 only in one direction, that is, forwards or backwards. The switching block 540 causes one of the two ratchet plates 530 to contact the locking protrusions 521 of the inner sleeve 520 according to the power transmission direction, thus converting a power transmission direction. The manipulation cover 550 serves to manipulate the switching block 540 from the exterior.

A guide slot 511 is formed in the circumference of the outer sleeve 510 to mount the switching block 540 to the outer sleeve 510. Seating grooves 512 are obliquely formed in both ends of the guide slot 511 in an axial direction thereof, and support the two ratchet plates 530 such that the ratchet plates undergo lever movement. The inner sleeve 520 is coupled to the inner circumference of the outer sleeve 510 with a bearing 560 interposed between the inner sleeve 520 and the outer sleeve 510.

Protruding tabs 531 are provided on opposite sides of one end of each ratchet plate 530, so that the protruding tabs are oppositely fitted into the seating grooves 512 of the outer sleeve 510, and are positioned on both sides of the locking protrusions 521 in an axial direction thereof. A locker 532 protrudes from a free end of each ratchet plate 530, and is selectively positioned between one locking protrusion 521 and both sides of the guide slot 511 in a circumferential direction thereof.

The switching block 540 has locking steps 541 which protrude from both sides of the bottom thereof. The locking steps 541 are seated on the two ratchet plates 530 so that the switching block 540 is axially movable in the guide slot 511 of the outer sleeve 510. The switching block 540 is secured to a predetermined position by an arc-shaped cover plate 570, which has a through slot 571 and is fastened to the outer sleeve 510.

A plate spring 542 having an inverted V shape is attached to the bottom of the switching block 540. Both ends of the plate spring 542 press the two ratchet plates 530. Thereby, the locker 532 of one of the ratchet plates 530 performs lever movement so that the ratchet plate is removed from the locking protrusion 521 of the inner sleeve 520. Meanwhile, the locker 532 of the other ratchet plate 530 is caught between the locking protrusion 521 and the circumference of the guide slot 511.

The manipulation cover 550 comprises two tubular cover parts 550*a* and 550*b*, and is mounted to the outer portion of the outer sleeve 510 to surround the switching block 540, with a spacer 552 interposed between the outer sleeve 510 and the manipulation cover 550. An annular guide channel 551 is provided in the inner circumference of the manipulation cover to rotatably accommodate the switching block 540 therein. Thus, the manipulation cover 550 is coupled to the outer sleeve 510 and is rotated relative to the outer sleeve 510.

As shown in FIG. 8, a central portion of the direction conversion lever 60 is supported to a center of the left or right frame 11 of the chassis 10 via a pivot 61, so that the direction conversion lever 60 is positioned to be rotated leftwards and rightwards between the two seats 30. Further, the direction conversion lever 60 connects the manipulation covers 550 of the two one-way clutches 50 to each other via a connecting bar 62, and the lower end of the direction conversion lever 60 is connected to the center of the connecting bar 62 via a pivot 63, thus simultaneously conducting the direction converting operation of the two one-way clutches 50.

Each brake unit 70 comprises a general hydraulic brake system which includes a brake disc 71, a caliper 72, and a hand brake lever 73. The brake disc 71 is mounted to the driving axle 23 to which the one-way clutches 50 are mounted. The caliper 72 is mounted to one side of the chassis 10 and selectively engages with the brake disc 71. The hand brake lever 73 is connected to the caliper 72 via a hydraulic cable 74, thus selectively operating the caliper 72.

The hand brake lever 73 may be independently mounted to the chassis 10. Preferably, the hand brake lever 73 is integrally mounted to the direction conversion lever 60 so that convenient direction conversion is realized under a reliable braking condition.

More preferably, a guide plate 80 is provided on the chassis 10, and has a shift range slot 81 so that the direction conversion lever 60 and the hand brake lever 73 are movably fitted into the shift range slot, thus precisely guiding the direction conversion lever 60 and the hand brake lever 73. The guide plate controls the direction conversion lever 60 so that the direction conversion lever is rotated only when the hand brake lever 73 is pulled.

The shift range slot 81 has a U shape, and includes a shift part 81*a* and two positioning parts 81*b* and 81*c*. The shift part 81*a* permits left and right movement of the direction conversion lever 60 only when the hand brake lever 73 is pulled. The positioning parts 81*b* and 81*c* are bent and extended from both ends of the shift part 81*a* in the same direction, and release the hand brake lever 73, in addition to preventing the movement of the direction conversion lever 60. Further, the shift part 81*a* has a locking recess 81*d* to lock the direction conversion lever 60 at a predetermined position in the state where the hand brake lever 73 is pulled.

Of course, a foot brake pedal may be used in place of the hand brake lever 73. However, in this case, an additional parking brake is undesirably required to park or stop the rail bike. Further, when passengers desire to convert the direction, double operation is required, thus incorrect manipulation is probable. Thus, the foot brake pedal is not desirable.

Meanwhile, the brake unit 70 is preferably provided on each of front and rear portions of the chassis 10 in the moving direction of the rail bike, and brakes both the front wheels 21 and the rear wheels 22. Such a construction allows the passengers U, who are facing the front relative to the moving direction of the rail bike, to safely manipulate the associated brake unit 70 regardless of the manipulation of the crank pedals 40, because the rail bike 1 of the present invention is driven in both directions while the passengers U face each other.

However, the direction conversion lever 60 is provided only on the side having the one-way clutches 50. Thus, the hand brake lever 73 mounted to a side where the direction conversion lever 60 is not installed is provided with a handle 75 which is supported to the chassis 10 via a pivot, and is integrated with the handle 75. In such a state, the hand brake lever 73 integrated with the handle 75 is fitted into the shift range slot 81 of the guide plate 80.

In this case, the guide plate 80 provided at a position at which the direction conversion lever 60 is not installed, has only to lock the hand brake lever 73 in a braking state or a releasing state. Thus, the shift range slot 81 may simply have an L shape.

The operation of the human powered rail bike according to the present invention having the above-mentioned characteristics will be described below.

First, two or four passengers U sit in the facing seats 30 of the stopping rail bike 1 so that the passengers face each other. At this time, the hand brake lever 73 of the brake unit, 70 positioned at least one side, is fitted into the locking recess 81*d* in the shift part 81*a* of the shift range slot 81 while the hand brake lever 73 is pulled towards the direction conversion lever 60 or the handle 75, as shown by the solid line of FIG. 9. Thus, the caliper 72 holds the brake disc 71 using hydraulic pressure, so that the rail bike 1 maintains a stopped state.

In such a state, the hand brake lever 73 is further pulled towards the direction conversion lever 60. The passenger holds both the hand brake lever and the direction conversion lever to move them leftwards or rightwards, so that the one-way clutches 50 transmits power only in a moving direction. Thereafter, the force restraining the hand brake lever 73 is released. In this case, the hand brake lever 73 is positioned in either of the positioning parts 81*b* and 81*c* of the U-shaped shift range slot 81 due to the elasticity, thus releasing the braking state of the brake disc 71. Thereby, the rail bike 1 may be driven.

At this time, the hand brake lever 73 integrated with the direction conversion lever 60 is locked to either of the positioning parts 81*b* and 81*c* of the U-shaped shift range slot 81, so that the direction conversion lever cannot move in the opposite direction. Thus, conversion of the direction is impossible while the rail bike 1 is moving.

In this case, the operation of converting the direction of the one-way clutches 50 is as follows. By the manipulation of the passengers U, the direction conversion lever 60 rotates about the pivot 61, so that the connecting bar 62 connected to the lower end of the direction conversion lever 60 via the pivot 63 moves in the direction opposite the direction conversion lever 60. Thereby, the manipulation cover 550 of each one-way clutch 50 mounted to the axle 23 slides leftwards or rightwards in an axial direction.

Then, the switching block 540 moves along the manipulation cover 550, so that one end of the plate spring 542 is elastically restored. At this time, one side, for example, the upper surface of the support end of the left ratchet plate 530, is pressed. Simultaneously, the other end (right end) of the plate spring 542 is elastically deformed, so that the upper surface of the free end of the right ratchet plate 530 is pressed.

Thus, the free end of the left ratchet plate 530 is raised upwards by the inclined seating groove 512 of the outer sleeve 510. The locker 532 of the left ratchet plate 530 is dislodged from the locking protrusion 521 of the inner sleeve 520. Conversely, the free end of the right ratchet plate 530 moves downwards relative to the seating groove 512 through lever movement. Thereby, the locker 532 is caught between the locking protrusion 521 of the inner sleeve 520 and one side of the guide slot 511 of the outer sleeve 510, so that power can be transmitted only in one direction.

Meanwhile, when the passengers desire to transmit power in a backward direction, the manipulation cover 550 is moved in the opposite direction. At this time, the function of the left and right ratchet plates 530 is changed by the switching block 540, so that the power transmission direction is converted.

Next, in the state where the one-way clutches 50 are manipulated to transmit power in a moving direction, for example, two passengers U who are facing the front relative to the moving direction rotate the crank pedals 40 with the feet to move the bike in a forward direction. In this case, the rotating force of the crank pedals 40 is transmitted to the outer sleeves 510 of the one-way clutches 50 by the chains 42. At this time, the locker 532 of the right ratchet plate 530 of each one-way clutch 50 is caught between the locking protrusion 521 of the inner sleeve 520 and the guide slot 511 of the outer sleeve 510. Thus, the inner sleeve 520 is rotated along with the outer sleeve 510.

Therefore, the axle 23 mounted to the front wheels 21 or the rear wheels 22 secured to each inner sleeve 520 is also rotated, so that the rail wheels 20 mounted to the axle 23 rotate forwards, and thus the rail bike 1 is driven.

Further, when the passengers U who operate the crank pedals 40 become tired, or it is required for other passengers to pedal for other reasons during the driving of the rail bike, opposite passengers U can conveniently continue to operate the crank pedals 40 without exchanging seats, because the passengers U sit to face each other and the crank pedals 40 are positioned between the facing passengers U. Thus, it is possible to conveniently move a relatively long distance without the excessive consumption of physical strength.

Meanwhile, when the passengers desire to stop the rail bike or change the moving direction during the driving of the rail bike, the passengers U who are facing the front relative to the moving direction pull the hand brake lever 73 regardless of which passengers U are pedaling. Thereby, the speed of the rail bike is slowly reduced, and the rail bike is braked.

Further, when the rail bike 1 has been completely stopped, the hand brake lever 73 is completely pulled. In such a state, the hand brake lever is positioned at the center of the shift part 81*a* of the shift range slot 81 together with the direction conversion lever 60, so that the rail bike maintains the stopped state. Or, the hand brake lever is completely moved to the opposite side of the shift part 81*a*, so that the power transmission direction of each one-way clutch 50 is changed to the backward direction. Afterwards, the restrained hand brake lever 73 is released, so that the braked rail wheels 20 are released. Simultaneously, the direction conversion lever 60 is secured to a predetermined position.

In this case, converse to the forward movement, the passengers U who are facing the rear rotate the crank pedals 40, and the rail bike is driven. When necessary, the passengers U conveniently and alternately pedal and operate the rail bike without exchanging seats with the facing passengers U.

According to this embodiment, four people get into the rail bike. However, this is only illustrative and the invention is not limited to this embodiment. For example, although not shown in the drawings, the rail bike may be built for two people.

Hereinafter, one embodiment of a safety switch device for manipulating the one-way clutch capable of changing direction, according to the present invention, will be described in detail with reference to the accompanying drawings. The portion which is not shown in the drawings will be described with reference to FIGS. 5 to 7 and FIG. 10.

As shown in FIGS. 11 to 13, the safety switch device 100 for manipulating the one-way clutch capable of changing direction according to the present invention includes a direction conversion lever 110, a brake disc 120, a hydraulic caliper 130, a hand brake lever 140, and a guide plate 150. The direction conversion lever 110 converts the power transmission direction of a one-way clutch 1, which is capable of changing direction and is mounted to an axle S of a human powered vehicle (not shown), like the rail bike, in the forward or backward direction. The hydraulic caliper 130 restrains the rotation of the brake disc 120. The hand brake lever 140 operates the hydraulic caliper 130. The guide plate 150 guides and controls the operation of the direction conversion lever 110 and the hand brake lever 140.

The direction conversion lever 110 is rotatably mounted to a chassis F of the human powered vehicle via a pivot 112. The lower end of the direction conversion lever 110 is fastened via a bolt 113 to the outer circumference of a manipulation cover 50 of the one-way clutch 1, which is capable of changing direction and is mounted to the axle S. Preferably, the direction conversion lever 110 has on an upper end thereof a handle 111 to facilitate the manipulation.

The brake disc 120 is integrally secured to the axle S having on both ends thereof driving wheels 20, and is rotated along with the axle S. The hydraulic caliper 130 is mounted to the chassis F to surround part of the brake disc 120.

The hand brake lever 140 is hinged to the upper end of the direction conversion lever 110, and is elastically biased away from the handle 111. Thus, the hand brake lever 140 can approach or move away from the handle 111. The hand brake lever 140 is connected to the hydraulic caliper 130 via a cable 141, thus selectively operating the hydraulic caliper 130.

The guide plate 150 is mounted to the chassis F to guide the precise manipulation of the direction conversion lever 110 and the hand brake lever 140. A shift range slot 151 is provided in the guide plate so that the direction conversion lever and the hand brake lever are movably fitted into the shift range slot. Thereby, only when the hand brake lever 140 is pulled and the brake disc 120 is restrained can the direction conversion lever 110 rotate.

The shift range slot 151 has a U shape, and includes a shift part 152 and two positioning parts 153 and 154. The shift part 152 permits the left and right movement of the direction conversion lever 110 only when the hand brake lever 140 is pulled. The positioning parts 153 and 154 are bent and extended from both ends of the shift part 152 in the same direction, and permit the release of the hand brake lever 140, in addition to preventing the movement of the direction conversion lever 110.

Further, a locking recess 155 is preferably formed in the shift part 152 to lock the pulled hand brake lever 140 in a predetermined position.

Meanwhile, as shown in FIGS. 16 to 18, a brake wire 140 for operating a hydraulic caliper 130 and a guide plate 150 for guiding and controlling the operation of a direction conversion lever 110 may be provided.

The direction conversion lever 110 includes a first lever 111 and a second lever 112. The first lever 111 serves to axially slide the manipulation cover 50 of the one-way clutch 1, which is capable of changing direction and is mounted to the axle S. The second lever 112 serves to operate the hydraulic caliper 130.

The first lever 111 has on the upper end thereof a fork bracket 113, and is rotatably mounted to the chassis F of the human powered vehicle via a pivot 114. The lower end of the first lever is fastened via a bolt 115 to the outer circumference of the manipulation cover 50 of the one-way clutch 1 which is capable of changing direction and is mounted to the axle S.

The lower end of the second lever 112 is inserted into the fork bracket 113 which is provided on the upper end of the first lever 111, and is coupled to the first lever 111 via a pivot 116 to be rotated in a direction perpendicular to the first lever 111. A handle 117 is provided on the upper end of the second lever 112 to facilitate manipulation.

The brake wire 140 connects the second lever 112 of the direction conversion lever 110 to the hydraulic caliper 130, and is elastically biased towards the hydraulic caliper 130, so that the brake wire 140 is operated in conjunction with the rotation of the second lever 112, thus selectively operating the hydraulic caliper 130.

Preferably, the brake wire 140 is guided along a guide pulley 141 which is provided on the chassis F, so as to ensure precise operation.

The guide plate 150 is mounted to the chassis F to guide the precise manipulation of the direction conversion lever 110, and is provided with a shift range slot 151 in which the second lever 112 is movably inserted. Thereby, only when the second lever 112 is pulled and the brake disc 120 is restrained is the rotation of the first lever 111 possible.

The shift range slot 151 has a U shape, and includes a shift part 152 and two positioning parts 153 and 154. The shift part 152 permits the left and right movement of the first lever 111 only when the second lever 112 of the direction conversion lever 110 is pulled. The positioning parts 153 and 154 are bent and extended from both ends of the shift part 152 in the same direction, and permits the release of the second lever 112, in addition to preventing the movement of the first lever 111.

Further, a locking recess 155 is preferably formed in the shift part 152 to lock the second lever 112 of the direction conversion lever 110 to a pulled position.

The operation of the safety switch device 100 for manipulating the one-way clutch capable of changing direction according to the present invention, which is constructed as described above, will be described below with reference to FIGS. 13*a* and 13*b*.

As shown by the solid lines of FIGS. 13*a* and 13*b*, the hand brake lever 140 is pulled towards the handle 111 of the direction conversion lever 110, so that the hand brake lever 140 is locked to the locking recess 155 of the shift part 152 of the guide plate 150. In this case, the hydraulic caliper 130 is operated by the brake lever 140, thus holding the brake disc 120. Thereby, the axle S is completely stopped.

In such a state, when one desires to transmit power in a forward direction, a passenger holds both the handle 111 and the hand brake lever 140, and further pulls the hand brake lever 140. Further, the handle 111 and the hand brake lever 140 are moved to the left side of FIG. 13*b*, as shown by the imaginary line.

At this time, as shown by the imaginary lines of FIG. 12, the direction conversion lever 110 rotates around the pivot 112, and moves rightwards the manipulation cover 50 of the one-way clutch 1 capable of changing direction Thereby, the switching block 40 is simultaneously moved, so that the plate spring 41 presses the upper surface of the support end of one ratchet plate 30, and rotates the ratchet plate upwards. Simultaneously, the plate spring 41 presses the upper surface of the free end of the other ratchet plate 30, so that the ratchet plate is positioned between the locking protrusion 21 of the inner sleeve 20 and the guide slot 11 of the outer sleeve 10.

Subsequently, the restraint of the hand brake lever 140 is released. Then, the hand brake lever 140 is positioned on the left positioning part 153 of the U-shaped shift range slot 151 by elastic restoring force. Thereby, the braking force of the brake disc 120 is released, so that the axle S is rotatable.

At this time, the hand brake lever 140 integrated with the direction conversion lever 110 is locked to one positioning part 153 of the U-shaped shift range slot 151, so that movement of the direction conversion lever 110 in the opposite direction is impossible. Thus, it is impossible to convert the direction while the axle S is rotating.

In such a state, for example, when the crank pedal Pc is rotated forwards, the outer sleeve 10 of the one-way clutch 1 capable of changing direction is rotated by means of a chain C in the same direction. Thereby, the inner sleeve 20 locked to one ratchet plate 30 is rotated forwards, so that the axle S secured to the inner sleeve 20 is rotated together therewith.

Meanwhile, when one desires to change the moving direction during driving, the hand brake lever 140 located at the left positioning part 153 of the shift range slot 151 is pulled towards the handle 111. Then, the hydraulic caliper 130 is operated by the cable 141, so that the brake disc 120 is caught and restrained. Thereby, the axle S is stopped.

Subsequently, in the state where the hand brake lever 140 is completely pulled, the hand brake lever 140 and the handle 111 move to the right end of the shift range slot 151, as shown by the dotted lines of the drawing. Then, as shown by the dotted lines of FIG. 12, the direction conversion lever 110 is rotated in the opposite direction, thus sliding the manipulation cover 50 of the one-way clutch 1 capable of changing the direction to the opposite side.

Thereby, the switching block 40 is moved to the opposite side, so that the position of the two ratchet plates 30 is changed, unlike the position thereof when forward movement is carried out. Thus, the power transmission direction is converted to the backward direction.

Subsequently, when the restraint of the hand brake lever 140 is released, the hand brake lever 140 is located at the right positioning part 154, so that movement of the direction conversion lever 110 is impossible. The hydraulic caliper 130 releases the restraint of the brake disc 120, so that the axle S is rotatable.

In such a state, when the crank pedals Pc are rotated backwards, the axle S is rotated in the direction opposite the direction of forward movement.

Meanwhile, FIGS. 14 and 15 show important parts of another embodiment according to the present invention.

According to this embodiment, the shift range slot 151 of the guide plate 150 has a rectangular shape, and a gap adjusting plate 160 is fastened to one side of the upper surface of the guide plate 150 by an adjusting bolt 163, thus partitioning the shift range slot 151 into the shift part 152 and the two positioning parts 153 and 154. The gap adjusting plate 160 has a longitudinal hole 161 for adjusting the position in the operating direction of the hand brake lever 140. In the embodiment, the locking recess 162 is formed on the front end of the gap adjusting plate 160 so that the hand brake lever 140 is locked to the locking recess 162.

The operation of another safety switch device 100 for manipulating the one-way clutch capable of changing direction according to the present invention, which is constructed as described above, will be described below with reference to FIGS. 18*a* and 18*b*.

In the case shown by the solid lines of FIGS. 18*a* and 18*b*, the second lever 112 of the direction conversion lever 110 is pulled backwards to be aligned with the first lever 111 in a row, and is locked to a predetermined position by the locking recess 155 in the shift part 152 of the guide plate 150. At this time, the hydraulic caliper 130 is operated by the brake wire 140, thus holding the brake disc 120. Therefore, the axle S is completely stopped.

In such a state, when one desires to transmit power forwards (forward moving direction), the second lever 112 of the direction conversion lever 110 is pulled further backwards, and moves to the left side of the drawing (FIG. 18*b*), as shown by the imaginary lines. Then, as shown by the imaginary lines of FIG. 17, the first lever 111 rotates about the pivot 114 counterclockwise, thus moving rightwards the manipulation cover 50 of the one-way clutch 1 capable of changing direction.

At this time, the switching block 40 is also moved, so that the plate spring 41 presses the upper surface of the support end of one ratchet plate 30, and the ratchet plate 30 rotates upwards. Simultaneously, the plate spring 41 presses the upper surface of the free end of the other ratchet plate 30, so that the ratchet plate 30 is disposed between the locking protrusion 21 of the inner sleeve 20 and the guide slot 11 of the outer sleeve 10.

Subsequently, the restraint of the second lever 112 is released. Then, the second lever 112 rotates about the pivot 116 to the front (the left side of FIG. 18), as shown by the imaginary line of FIG. 18*b*, by the elastic restoring force of the brake wire 140, so that the second lever 112 is obliquely located in the left positioning part 153 of the U-shaped shift range slot 151. Thus, the braking of the brake disc 120 is released, so that the axle S is rotatable.

At this time, the second lever 112 integrated with the first lever 111 of the direction conversion lever 110 is locked to one positioning part 153 of the U-shaped shift range slot 151, so that movement of the second lever in the opposite direction is impossible. Thus, while the axle S is rotating, it is impossible to convert a direction.

In such a state, for example, when the crank pedals Pc are rotated forwards, the outer sleeve 10 of the one-way clutch 1 capable of changing direction is rotated by the chain C in the same direction. Thus, the inner sleeve 20 locked to one ratchet plate 30 is rotated forwards, so that the axle S secured to the inner sleeve 20 is rotated together therewith.

Meanwhile, when one desires to change the moving direction while driving, the second lever 112, obliquely positioned in the left positioning part 153 of the shift range slot 151, is pulled backwards (right side of FIG. 18*b*). At this time, the hydraulic caliper 130 is operated by the brake wire 140, so that the brake disc 120 is held and restrained. Thereby, the axle S is stopped.

Subsequently, in the state where the second lever 112 is completely pulled, the second lever is moved to the right end of the shift range slot 151, as shown by the dotted lines. Then, as shown by the dotted lines of FIG. 17, the first lever 111 is rotated in the opposite direction, so that the manipulation cover 50 of the one-way clutch 1 capable of changing direction slides to the opposite side.

Thus, the switching block 40 is moved to the opposite side, so that the position of the two ratchet plates 30 becomes different from that of the ratchet plates during the forward movement, so that the power transmission direction is converted to the backward direction.

Subsequently, when the restraint of the second lever 112 is released, the second lever 112 is obliquely located in the right positioning part 154, so that rotation of the first lever 111 becomes impossible. The hydraulic caliper 130 releases the restraint of the brake disc 120, so that the axle S is rotatable.

In such a state, when the crank pedals Pc are rotated backwards, the axle S is rotated in a direction opposite the direction when the crank pedals are rotated forwards.

Meanwhile, FIG. 19 shows important parts of a further embodiment of the present invention.

According to this embodiment, the shift range slot 151 of the guide plate 150 has a rectangular shape, and a gap adjusting plate 160 is fastened to the upper surface of one side of the guide plate 150 via an adjusting bolt 163, thus partitioning the shift range slot 151 into the shift part 152 and the two positioning parts 153 and 154. The gap adjusting plate 160 has a longitudinal hole 161 for adjusting the position in an operating direction of the second lever 112 of the direction conversion lever 110.

In this case, the locking recess 162 is formed on the front end of the gap adjusting plate 160 so that the second lever 112 is locked to the locking recess.

In the embodiment constructed as described above, the position of the gap adjusting plate 160 relative to the guide plate 150 is appropriately adjusted according to the variable hydraulic pressure. Thus, when a vehicle maintains a stop state, such as parking or stopping, the brake disc 120 is completely held and is safely stopped.

The invention claimed is:

1. A human powered rail bike, comprising:

a chassis having a predetermined shape;

rail wheels comprising a pair of front wheels and rear wheels, which are mounted to front and rear portions of the chassis, are spaced apart from each other, and movably support the chassis on a track, the front and rear wheels being connected via respective axles and rolling along two rails of the track which are arranged side by side;

a plurality of seats mounted to the chassis, and arranged parallel to the track to be spaced apart from each other and face each other;

a one-way clutch capable of changing direction, the one-way clutch mounted to at least one axle and limiting a rotating direction of the associated axle to one direction, that is, a forward direction or a backward direction;

a plurality of crank pedals positioned at a center between the facing seats and rotatably mounted to the chassis, each of the crank pedals being connected to the one-way clutch capable of changing direction via a chain;

a direction conversion lever for converting a rotating direction of the one-way clutch capable of changing the direction; and a pair of brake units mounted to the front and rear portions of the chassis, and selectively or simultaneously reducing rotating speed of the front and rear wheels or stopping the front and rear wheels according to a moving direction.

2. The human powered rail bike according to claim 1, wherein each of the brake units comprises a hydraulic brake having a brake disc secured to each of the axles, a hydraulic caliper selectively holding the brake disc, and a hand brake lever connected to the caliper via a cable and operating the caliper, and the hand brake lever is mounted to the direction conversion lever.

3. The human powered rail bike according to claim 2, further comprising a guide plate having a shift range slot, the shift range slot comprising:

a shift part permitting movement of the direction conversion lever only when the hand brake lever is pulled; and positioning parts bent and extended from both ends of the shift part in the same direction, releasing restraint of the hand brake lever, and preventing movement of the direction conversion lever.

4. The human powered rail bike according to claim 1, wherein each of the seats is mounted to the chassis to be movable in a moving direction and to be secured to a predetermined position, so that an interval between the seat and the crank pedals is adjustable.

5. The human powered rail bike according to claim 4, wherein an upper plate is provided in a lower portion of a central region of the chassis so that the upper plate does not hinder pedaling motion.

6. The human powered rail bike according to claim 1, wherein the one-way clutch capable of changing direction comprises: an outer sleeve having on one end thereof a sprocket wheel, with a guide slot formed in a circumference of the outer sleeve;

an inner sleeve having a plurality of locking protrusions provided at regular angular intervals on an outer circumference of the inner sleeve to correspond to the guide slot, and inserted into the outer sleeve, with a bearing interposed between the outer sleeve and the inner sleeve, the axle being fitted into and secured to the inner sleeve;

a pair of ratchet plates supported on both ends of the guide slot in an axial direction thereof to permit lever movement, free ends of the ratchet plates being alternately positioned between each of the locking protrusions of the inner sleeve and a side of the guide slot in a circumferential direction thereof, so that the ratchet plates drive the outer sleeve and the inner sleeve in opposite directions;

a switching block supported in the guide slot to be movable in the axial direction thereof, and alternately and elastically pressing the ratchet plates so that each of the ratchet plates is located between each of the locking protrusions of the inner sleeve and a side of the guide slot in the circumferential direction thereof; and a manipulation cover coupled to an outer portion of the outer sleeve to surround the switching block, and moving the switching block in an axial direction.

7. A safety switch device for manipulating a one-way clutch capable of changing direction from an exterior, the one-way clutch including an outer sleeve having in a circumferential surface thereof a guide slot and connected to a shaft of a driving source via power transmission means, an inner sleeve radially having on an outer circumference thereof a plurality of locking protrusions to correspond to the guide slot, rotatably coupled to the outer sleeve, and secured to a driven shaft equipped with driving wheels, a pair of ratchet plates supported on both ends of the guide slot to undergo lever movement, a switching block moving in the guide slot in an axial direction thereof and alternately positioning each of the ratchet plates between each of the locking protrusions and a circumferential side of the guide slot, and a manipulation cover secured to surround the outer sleeve and moving the switching block, wherein the safety switch device comprises:

a direction conversion lever having on an upper end thereof a handle and supported to a chassis via a pivot, a lower end of the direction conversion lever being connected to the manipulation cover;

a brake disc secured to the driven shaft;

a hydraulic caliper selectively holding the brake disc, thus restraining or releasing the brake disc;

a hand brake lever connected to the hydraulic caliper via a cable, and mounted to the direction conversion lever via a pivot to move towards or away from the handle, thus operating the hydraulic caliper; and a guide plate having a shift range slot including a shift part permitting movement of the direction conversion lever only when the hand brake lever is pulled and the brake disc is restrained by the hydraulic caliper, and positioning parts bent and extended from both ends of the shift part in the same direction, releasing restraint of the hand brake lever, and preventing movement of the direction conversion lever.

8. The safety switch device according to claim 7, wherein a locking recess is formed in the shift part of the shift range slot of the guide plate, so that the hand brake lever is fitted into the locking recess while the hand brake lever is pulled.

9. The safety switch device according to claim 7, wherein the shift range slot of the guide plate has a rectangular shape, and a gap adjusting plate having a longitudinal hole for adjusting a position in an operating direction of the hand brake lever is fastened to a predetermined portion of the guide plate, thus partitioning the shift range slot into the shift part and the positioning parts, in addition to adjusting a width of the shift part.

10. The safety switch device according to claim 9, wherein a locking recess is formed in a front end of the gap adjusting plate, so that the hand brake lever is fitted into the locking recess while the hand brake lever is pulled, thus being secured to a predetermined position.

11. A safety switch device for manipulating a one-way clutch capable of changing direction from an exterior, the one-way clutch including an outer sleeve having in a circumferential surface thereof a guide slot and connected to a shaft of a driving source via power transmission means, an inner sleeve radially having on an outer circumference thereof a plurality of locking protrusions to correspond to the guide slot, rotatably coupled to the outer sleeve, and secured to a driven shaft equipped with driving wheels, a pair of ratchet plates supported on both ends of the guide slot to undergo lever movement, a switching block moving in the guide slot in an axial direction thereof and alternately positioning each of the ratchet plates between each of the locking protrusions and a circumferential side of the guide slot, and a manipulation cover secured to surround the outer sleeve and moving the switching block, wherein the safety switch device comprises:

a direction conversion lever having a first lever pivoted at an upper end thereof to a chassis and connected at a lower end thereof to the manipulation cover, and a second lever pivoted to the upper end of the first lever to be operated in a direction perpendicular to the first lever;

a brake disc secured to the driven shaft;

a hydraulic caliper selectively holding the brake disc, thus restraining or releasing the brake disc;

a brake wire connecting the second lever of the direction conversion lever to the hydraulic caliper, and elastically biased towards the hydraulic caliper; and a guide plate having a shift range slot including a shift part permitting rotation of the first lever only when the second lever of the direction conversion lever is pulled and the brake disc is restrained by the hydraulic caliper, and positioning parts bent and extended from both ends of the shift part in the same direction, releasing restraint of the second lever, and preventing rotation of the first lever.

* * * * *